US006457557B1

(12) United States Patent
Anderson et al.

(10) Patent No.: US 6,457,557 B1
(45) Date of Patent: Oct. 1, 2002

(54) TOOL FOR RETRIEVING A LADDER FROM AN ELEVATED POSITION

(76) Inventors: Leslie Anderson, 8119 Debbie Gay, Houston, TX (US) 77040; William Anderson, 8119 Debbie Gay, Houston, TX (US) 77040

( * ) Notice: Subject to any disclaimer, the term of this patent is extended or adjusted under 35 U.S.C. 154(b) by 0 days.

(21) Appl. No.: 09/604,477

(22) Filed: Jun. 27, 2000

(51) Int. Cl.[7] ..... E06C 1/20
(52) U.S. Cl. ..... 182/129; 294/19.1
(58) Field of Search ..... 182/129; 294/5.5, 294/19.1, 19.3, 81.56

(56) References Cited

U.S. PATENT DOCUMENTS

| | | | | |
|---|---|---|---|---|
| 124,943 | A | * | 3/1872 | Ferriss |
| 3,991,852 | A | | 11/1976 | Brookes et al. ..... 182/169 |
| 4,165,114 | A | * | 8/1979 | Nutter |
| 4,838,465 | A | * | 6/1989 | Metzger |
| 5,742,220 | A | * | 4/1998 | Scherer |
| 5,746,461 | A | * | 5/1998 | Broberg |

OTHER PUBLICATIONS

"Ez–One Ez–Ladder Loader", Mar. 4, 2000, 5 pages.

* cited by examiner

*Primary Examiner*—Alvin Chin-Shue

(74) *Attorney, Agent, or Firm*—Locke Liddell & Sapp LLP

(57) ABSTRACT

A ladder removal tool designed for use with any ladder that is supported at an elevated position and the method of its use are disclosed. The ladder may be an extension ladder or a large "A" frame ladder. The ladder removal consists of a lifting rod that has hook connected to one end by a pivot joint that allows the hook to rotate with respect to the lifting rod. The lifting rod has a substantially right angle bend adjacent the pivot joint to aid the user in reaching up and "hooking" or engaging the hook with a rung of the ladder to be lowered. The opposite end of the lifting rod has a handle attached thereto. Additionally, the leg of the hook attached to the lifting rod has a stabilizer arm attached thereto. The user reaches up and inserts the hook of the tool around a rung of the ladder while simultaneously allowing the stabilizer arm to extend over and engage the side rail of the ladder. Generally, the user lifts one end of the ladder clear of the rack, swings the ladder away from the truck and lowers the ladder to the ground, while the opposite end rotates around the safety bar on the rack. The user can then use the ladder removal tool to lift the opposite end and lower it to the ground. If desired, the user may use the tool to replace the ladder on the vehicle by simply reversing the order of operation.

12 Claims, 4 Drawing Sheets

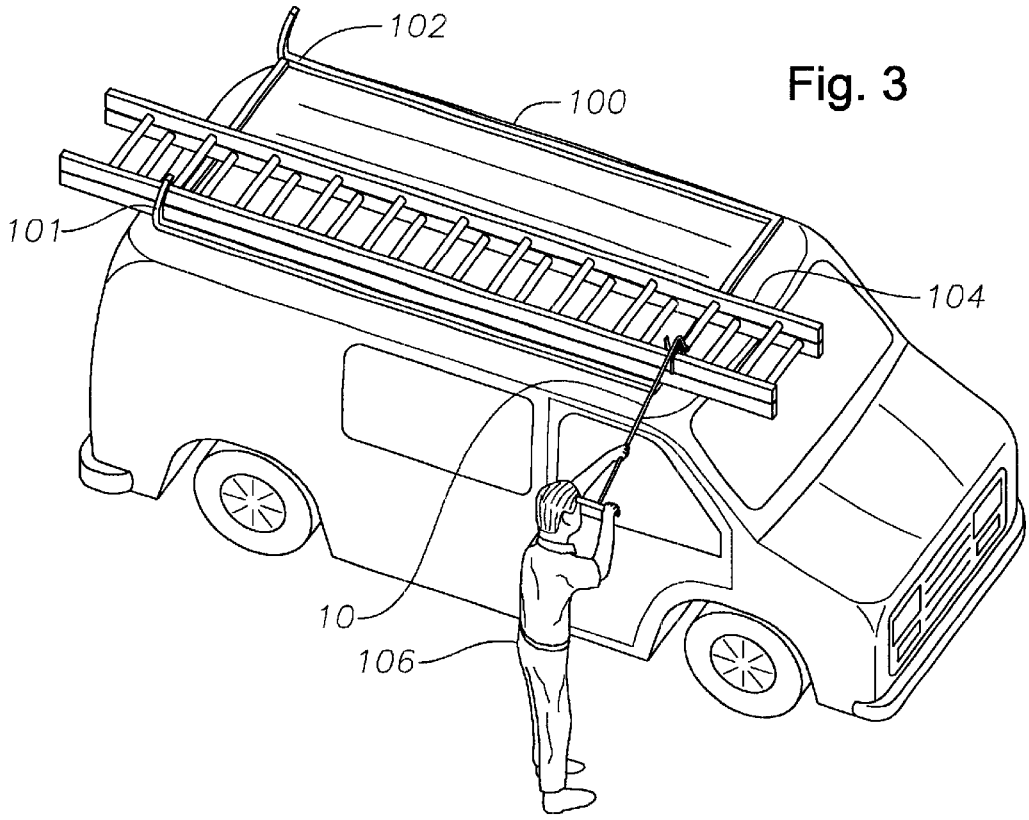
Fig. 3
Fig. 4
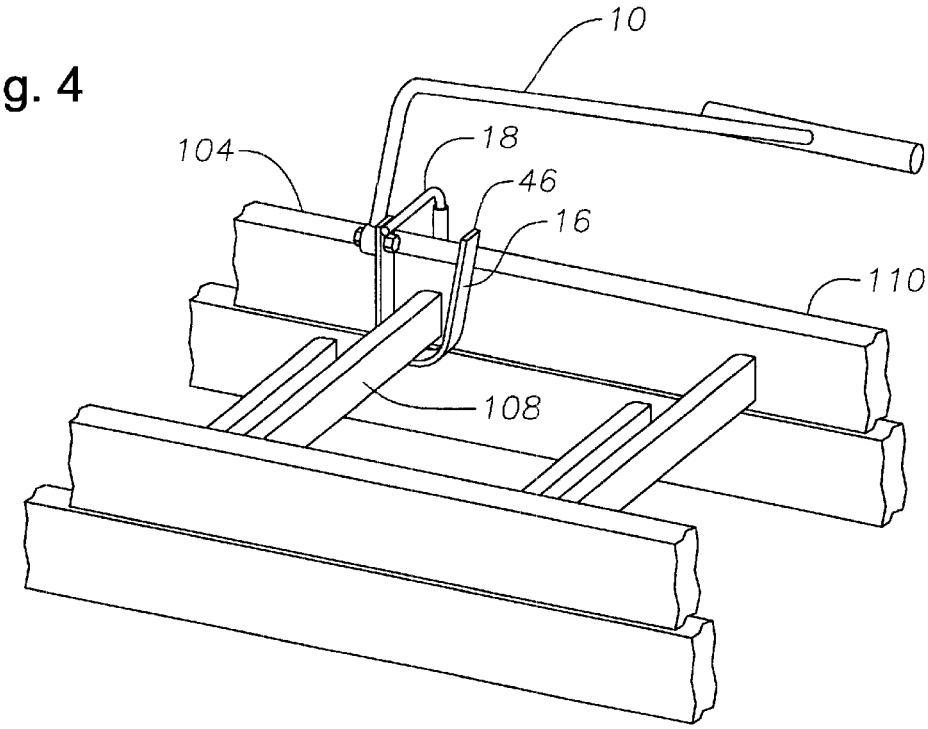

TOOL FOR RETRIEVING A LADDER FROM AN ELEVATED POSITION

BACKGROUND OF THE INVENTION

1. Field of the Invention

This invention relates to a tool for retrieving ladders from an elevated position such as the top of service van or truck and safely lowering the ladder to the ground. Typically, roofers, contractors or utility company service personnel carry large ladders, either extension or "A" frame type, on the roof of their service vehicle for use in their job. Upon reaching a job site, the user is faced with the difficult task of removing the aforementioned ladder from the roof of the service vehicle. Often, the ladder is at an elevation of 7 feet or more owing to the height of the vehicle and the rack to which such a ladder is usually secured, well above the height of the average person.

This places the user in the difficult position of having to either stand on a jury rigged platform such as an inverted large bucket or a shorter 3 to 4 foot step ladder that was carried in the service vehicle. In either case, the user in forced to stand on the bucket or ladder, often on soft, unstable ground, and attempt to then lift one end of the ladder and step off the bucket or walk down the ladder while supporting the weight of the ladder. This precarious operation often results in the user falling and having the ladder come crashing down on them or the user sustaining severe back injury or damaging muscles in the legs or arms. Therefore, there exists a need for an apparatus or tool that will allow a user of average or below average height to safely remove a large extension ladder from an elevated position such as the roof rack of a service vehicle to the ground. It is the construction and use of such a tool to which the present invention is directed.

2. Description of Related Art

U.S. Pat. No. 3,991,852 to M. J. Brookes et al. discloses a device that aids a user is raising one end of an extension to lean against a building to be scaled. A caddy also is shown that allows a user to roll the ladder about a job site.

Another apparatus for lowering a ladder from the roof of a vehicle to approximately chest height of the user is sold under the trademark "EZ-ONE EZ-LADDER LOADER" and advertised at the Internet Web Site http://www.weathernuard.com/ezone.html. This apparatus utilizes a clam shell rack apparatus that is operated through a series of pulleys to lower the ladder.

SUMMARY OF THE INVENTION

The ladder removal tool of the present invention is designed for use with any ladder that is generally supported at an elevated position. The ladder may be an extension ladder or a large "A" frame ladder. The ladder removal tool includes an elongate member or lifting rod that has hook connected to one end. The hook is generally "U" shaped and one leg of the "U" is connected to the lifting rod by a high strength bolt. In some embodiments, the hook is allowed to swivel relative to the lifting rod. The rod has an enlarged end piece or collar welded to one end. The bolt passes through a bore in the collar and is secured by a nut. The coupling between the lifting rod and hook forms a pivot joint.

The lifting rod has a bend adjacent the pivot joint to aid the user in reaching up and "hooking" or engaging the hook with a rung of the ladder to be lowered. The opposite end of the lifting rod has a handle attached thereto. The handle is of a "T" configuration and is covered by a padded covering.

Additionally, the leg of the hook attached to the lifting rod has a stabilizer arm attached thereto. The stabilizer arm extends at a substantially right angle from the leg of the hook with a short bend in its free end. The stabilizer arm has a rubber sleeve fitted thereon that prevents marring of the ladder siderail. The leg of the hook not attached to the lifting rod is slightly longer than the other leg. This slightly elongated leg acts as a visual indicator to the user the ladder removal tool has securely engaged the rung of the ladder to be lifted.

In order to use the ladder removal tool of the present invention, a user releases any clamps or similar securing means attaching the ladder to the service vehicle. The user then reaches up and inserts the hook of the tool around a rung of the ladder while simultaneously allowing the stabilizer arm to extend over and engage the side rail of the ladder. The user lifts a free end of the ladder clear of the rack with an upper arm and shoulder movement using the ladder removal tool. The opposite end of the ladder is generally restrained on the rack by a safety bar, such as a vertical upright bar, so that during the process of removal, the opposite end of the ladder rotates about the safety bar while the free end is removed from the rack. The user swings the ladder away from the truck using the pivot joint of the hook and lowers the ladder to the ground while being in control and generally away from danger of a falling ladder. The user can then use the ladder removal tool to lift the opposite end of the ladder over the safety bar and lower the ladder to the ground. If desired, the user may use the tool to replace the ladder on the vehicle by simply reversing the order of operation.

One object of the present invention is to provide a method for removing a ladder from an elevated position, such as a roof rack of a vehicle, without requiring a complicated or expensive apparatus or modifications to existing racks.

Other objects and advantages of the present invention are pointed out in the claims annexed hereto and form a part of this disclosure. A full and complete understanding of the invention may be had by reference to the accompanying drawings and description of the preferred embodiments.

BRIEF DESCRIPTION OF THE DRAWINGS

These and other objects and advantages of the present invention are set forth below and further made clear by reference to the drawings, wherein:

FIG. 3 is a perspective view showing the first step in using the ladder removal tool of the present invention to remove a ladder.

FIG. 4 is an enlarged view of the hook of the ladder removal tool of FIG. 3 engaging the ladder just prior to being lifted.

DESCRIPTION OF THE PREFERRED EMBODIMENT

Figure 1:
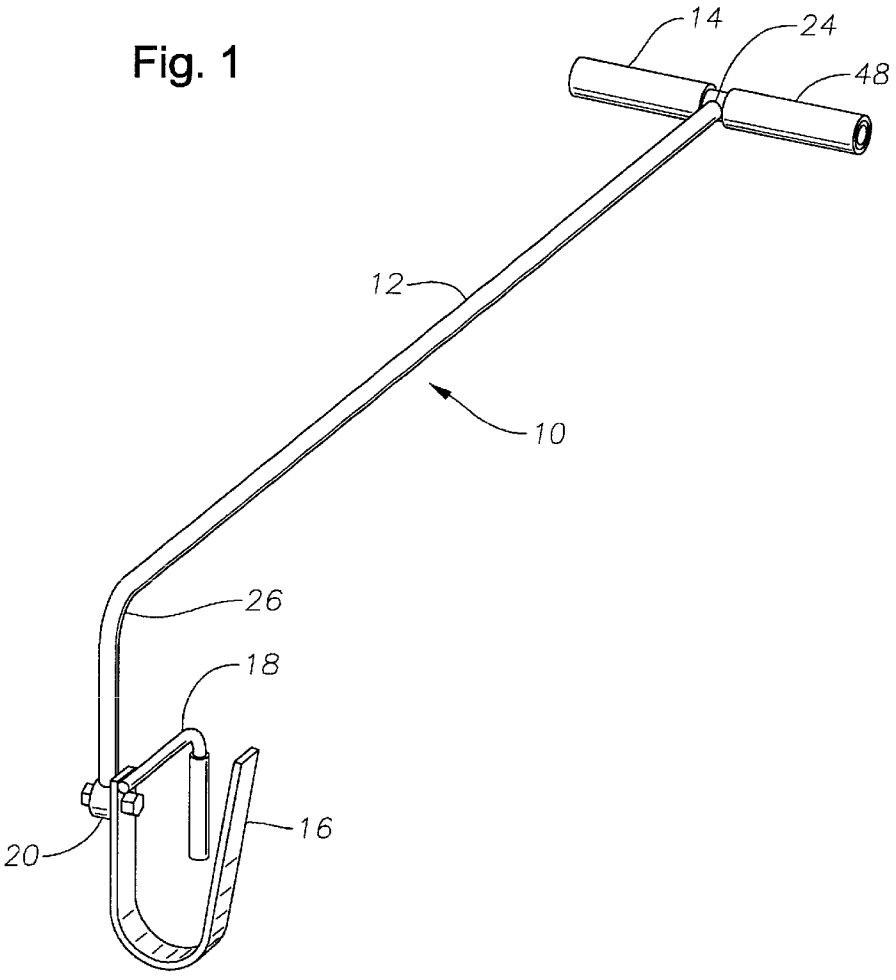
FIG. 1 is a perspective view of the ladder removal tool of the present invention.

With reference to the drawings, and particularly to FIG. 1, a perspective view of the ladder removal tool of the present invention is shown. The ladder removal tool of the present invention is denoted generally by numeral 10. Ladder removal tool 10 includes lifting rod 12, handle 14, hook 16, stabilizer arm 18 and pivot joint 20. Lifting rod 12 is constructed of round stock of suitable material such as steel, aluminum, fiberglass, graphite or other reinforced plastic materials having sufficient structural rigidity. Similarly, while lifting rod 12 is shown to be of a round cross section, it is envisioned other suitable cross sections, such as square, hexagon, octagon or tubular members, could be substituted without departing from the scope of the present invention. Handle 14 is a hollow tube and sized to allow a hole 22 to be drilled though one side. Handle 14 is inserted in hole 22 and secured by suitable means as weldment 24. The present invention includes all such equivalent alterations and modifications.

The opposite end of handle 14 has a bend 26 therein adjacent pivot joint 20. In a preferred embodiment, the bend is generally a right angle bend. Bend 26 is placed adjacent pivot joint 20 for purposes to be described hereinafter. Pivot joint 20 includes pivot collar 28 and suitable securing means as bolt 30 and nut 32. Pivot collar 28 is attached to the end of lifting rod 12 by suitable means such as welding. Pivot collar 28 has bore 34 therethrough that is sized to receive bolt 30 in close fitting engagement.

Hook 16 has a substantially "U" shaped configuration with a pair of vertical legs 36 and 38 joined by a curved intermediate portion 40. Vertical leg 36, adjacent pivot joint 20, includes hole 42 therethrough sized to receive bolt 30 in close fitting engagement and secure hook 16 to pivot collar 28. Attached to the upper end of vertical leg 36 is stabilizer arm 18, in some embodiments. Stabilizer arm 18 extends at a substantially right angle from vertical leg 36 of hook 16 and is secured thereto by suitable means such as welding. A 90 degree bend is formed in stabilizer arm 18 intermediate its ends for purposes to be explained hereinafter. A rubber sleeve 44 is positioned on stabilizer arm 18 to prevent marring of the ladder. Extension 46 of vertical leg 38 extends above vertical leg 36. Extension 46 acts as a visual indicator that hook 16 is properly engaging a rung of a ladder to be lifted in a manner to be described hereinafter. A padded covering 48 is placed on handle 14 to cushion the user's hands during use.

Figure 2:
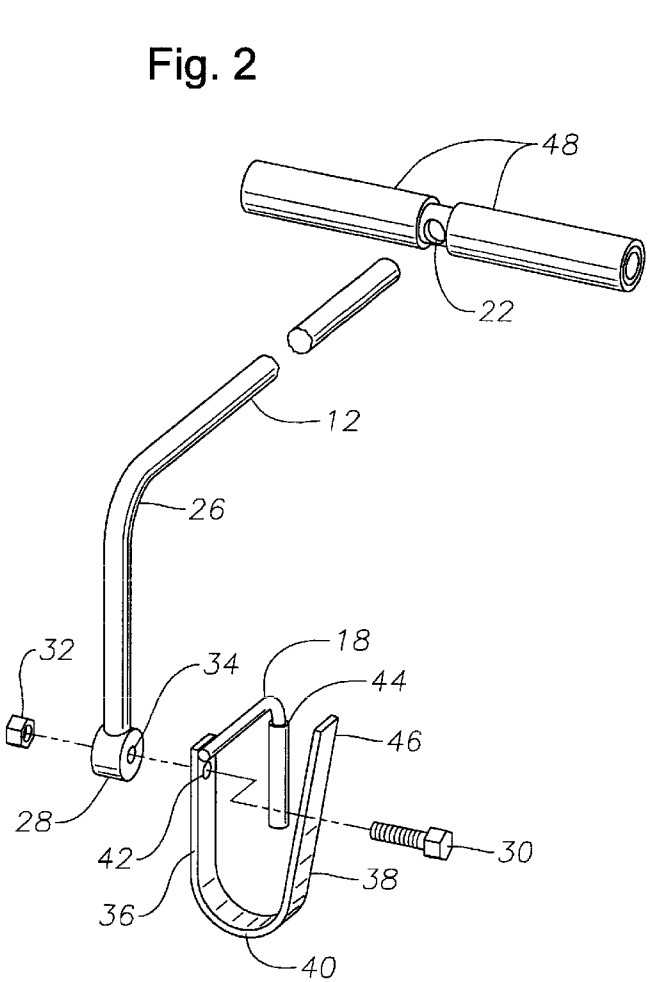
FIG. 2 is an exploded view of the ladder removal tool of FIG. 1, showing the constituent parts.
Figure 5:
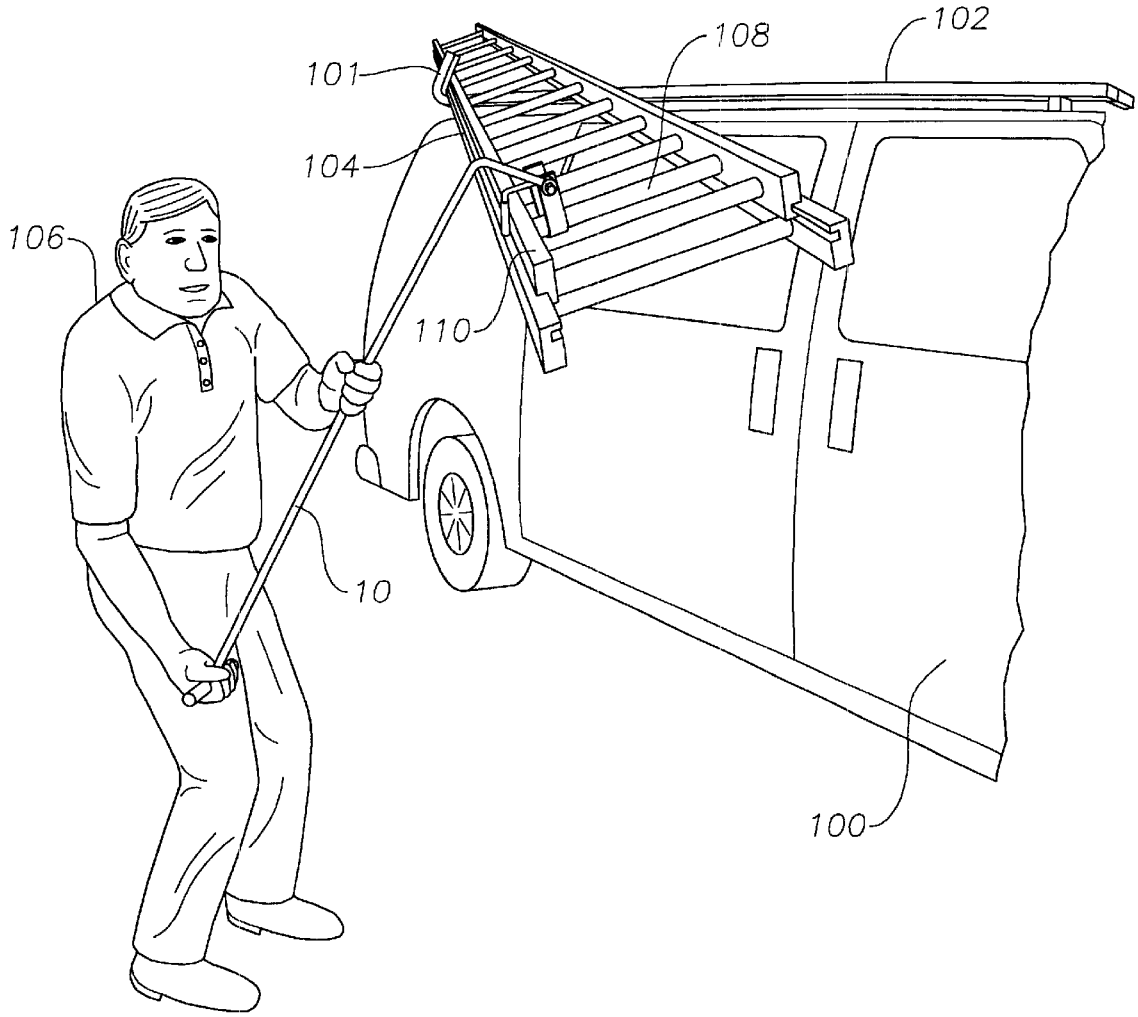
FIG. 5 is a perspective view showing the second step in using the ladder removal tool of the present invention to remove a ladder with the user supporting the end of the ladder with the tool as the user swings the ladder away from the truck and begins lowering it the ground.
Figure 6:
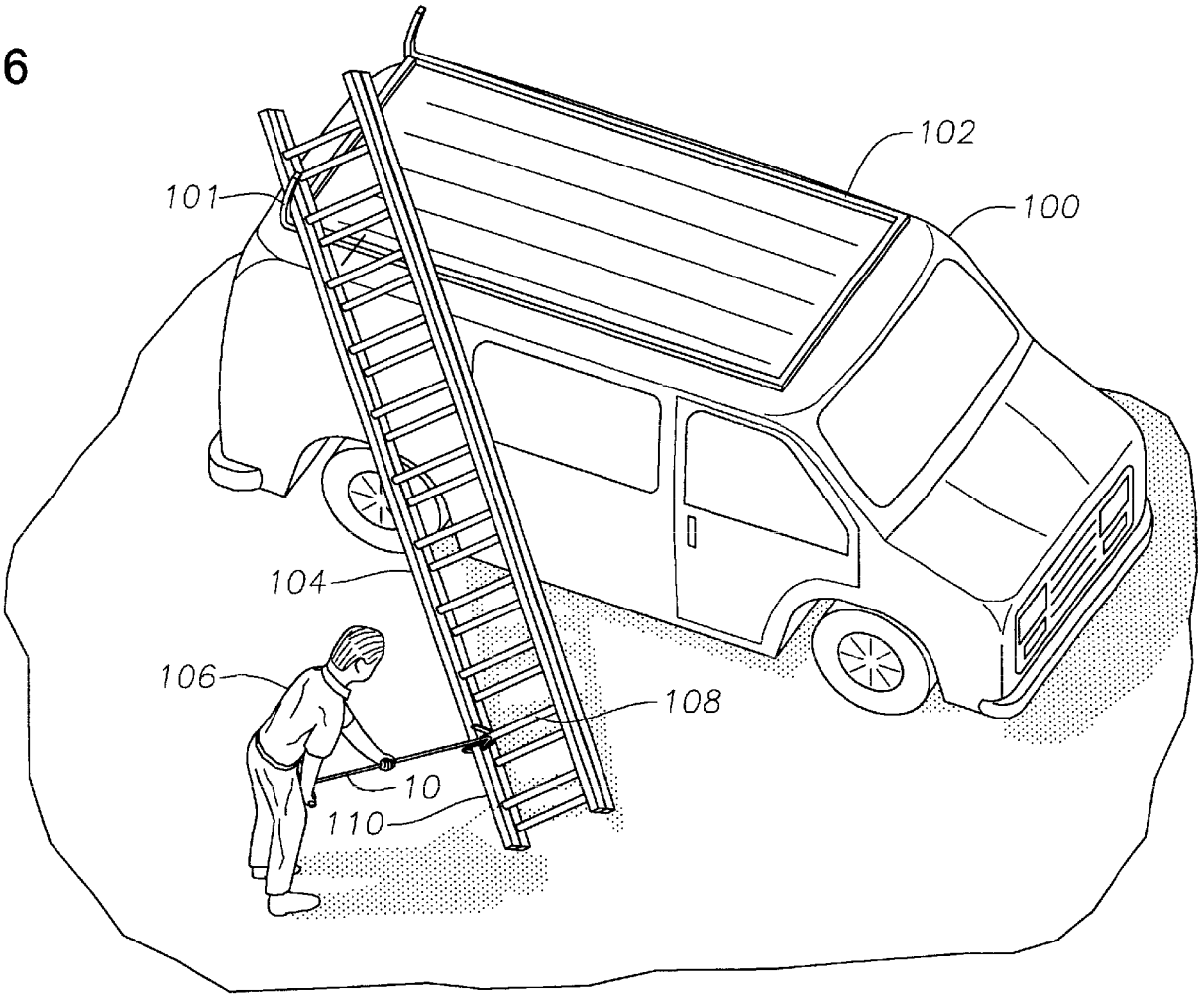
FIG. 6 is a perspective view showing the third step in using the ladder removal tool of the present invention to remove a ladder with the user resting the end of the ladder on the ground and preparing to disengage the tool from the ladder rung.

The method of use of ladder removal tool 10 is best seen in FIGS. 3–6 in conjunction with the elements described in FIGS. 1 and 2. Referring to FIG. 3, a service vehicle such as van 100 is shown with roof rack 102 attached thereto and a safety bar 101 located at the rear of the rack. However, the safety bar 101 can be located at different positions on the rack 102. The safety bar restrains the ladder on the rack 102 while the free end of the ladder is lifted free of the rack. A ladder 104 can be mounted on the rack 102 in a substantially horizontal position. User 106 first releases any clamps or similar securing means that secure ladder 104 to roof rack 102. User 106 grasps ladder removal tool 10 of the present invention as shown. User 106 reaches upwardly, while remaining standing on the ground, and engages hook 16 with rung 108 of ladder 104. For example, the user can position the lifting rod 12 so that the hook 16 is placed under the rung 108, and then twists the lifting rod, so that the hook "scoops" the rung from the side of the ladder. The stabilizer arm 18 may engage the side rail 110 of ladder 104. User 106 next ascertains that the visual indicator of extension 46 of vertical leg 38 indicates hook 16 is properly engaging rung 108 of ladder 104 as can seen in FIG. 3. User 106 then lifts generally a free end of ladder 104 to ensure it clears roof rack 102, swings it away from the truck as best seen in FIG. 5, and then lowers the end of ladder 104 to a desired lower position as the ground, as shown in FIG. 6 while an opposite end of the ladder rotates around the safety bar 101. The hook 16 and lifting rod 12 can pivot about pivot joint 20 as the ladder is lifted from the rack and lowered to the ground. User 106 may then repeat the previous steps for the opposite end of the ladder 104 to lower it to the ground also if desired. The user then disengages the ladder removal tool 10 by twisting the lifting rod 12 so that the hook 16 rotates from the ladder rung 108 and lifts the ladder removal tool 10 from the ladder. Similarly, the steps could be reversed when user 106 wishes to return ladder 104 to the elevated position on roof rack 102 of van 100.

The construction of our ladder removal tool will be readily understood from the foregoing description and it will be seen that we have provided a ladder removal tool for extension or "A" frame ladders that is inexpensive and easily allows a user to retrieve a ladder from an elevated position. Furthermore, while the invention has been shown and described with respect to certain preferred embodiments, it is obvious that equivalent alterations and modifications will occur to others skilled in the art upon the reading and understanding of the specification. For example, different angles for the bends or differently shaped handles, hooks and lifting rods can be used. The present invention includes all such equivalent alterations and modifications, and is limited only by the scope of the appended claims.

What is claimed is:

1. A ladder removal tool to aid in removing a ladder from an elevated position, comprising:

a lift rod;

a hook pivotally connected to said lifting rod, said hook having two legs defining a plane passing through said hook and adapted to engage a ladder to reposition said ladder having at least one side rail and at least one rung connected to said side rail; and, an shaped stabilizer arm attached to said hook, said stabilizer arm extending at a perpendicular angle to said plane and having a free end and adapted to retain said hook adjacent said side rail of said ladder.

2. The ladder removal tool according to claim 1, wherein:

a portion of said L-shaped stabilizer arm extends parallel to the plane passing through said hook and said hook is adapted to engage said rung of said ladder, and said stabilizer arm is disposed relative to said hook so that said stabilizer arm is adapted to be positioned beside one side of said rail and said hook is adapted to be positioned beside another side of said rail when said hook has engaged said rung.

3. The ladder removal tool according to claim 1, wherein;

said liming rod includes a bend in said lifting rod proximate said pivot joint.

4. The ladder removal tool according to claim 1, wherein one of said legs extends above another of said legs.

5. The ladder removal tool according to claim 4, wherein said lifting rod includes:

a handle attached to said lifting rod, said handle extends laterally either side of said lifting rod to form a "T" joint.

6. The ladder removal tool according to claim 1, wherein:

said hook extends at an angle to said lifting rod.

7. A ladder removal tool to aid in moving a ladder from a first position to a second position, said ladder having at least one side rail and at least one rung connected to said side rail, comprising:

a lifting rod;

a hook pivotally attached to said lifting rod, said hook having two legs defining a plane passing through said hook and extending at an angle to said lifting rod and adapted to engage said ladder to reposition said ladder when said ladder is in an elevated substantially horizontal plane and to continue said engagement when said ladder is moved to a lower position; and, an L-shaped stabilizer arm attached to said hook and extending at a perpendicular angle to said plane and having a free end so that said stabilizer arm is adapted to be positioned beside one side of said rail and said hook is adapted to be positioned beside another side of said rail when said hook has enamel said rung.

8. The ladder removal tool according to claim 7, wherein a portion of said L-shaped stabilizer arm extends parallel to the plane passing through said hook and said stabilizer arm is adapted to retain said hook adjacent said side rail of said ladder.

9. The ladder removal tool according to claim 7, wherein:

said lifting rod includes a bend in said lifting rod proximate said hook.

10. The ladder removal tool according to claim 9, wherein:

said bend in said lifting rod is substantially a right angle.

11. The ladder removal tool according to claim 7, wherein one of said legs extends above another of said legs.

12. The ladder removal tool according to claim 11, wherein said lifting rod includes:

a handle attached to said lifting rod, said handle extends laterally either side of said lifting rod to form a "T" joint.

* * * * *

UNITED STATES PATENT AND TRADEMARK OFFICE

CERTIFICATE OF CORRECTION

PATENT NO. : 6,457,557 B1
DATED : October 1, 2002
INVENTOR(S) : Anderson et al.

It is certified that error appears in the above-identified patent and that said Letters Patent is hereby corrected as shown below:

Column 4,
Line 36, please delete the first occurrence of “lift” and insert therefor -- lifting --.
Line 43, following “an” and before “shaped” please insert -- L- --.
Line 56, please delete “wherein; said liming” and insert therefor
-- wherein: said lifting --.

Column 5,
Line 19, please delete “enamel” and insert therefor -- engaged --.

Signed and Sealed this

First Day of April, 2003

JAMES E. ROGAN
*Director of the United States Patent and Trademark Office*